US009468287B1

(12) United States Patent
Barnard et al.

(10) Patent No.: US 9,468,287 B1
(45) Date of Patent: Oct. 18, 2016

(54) COSMETIC BRUSH CLEANING DEVICE

(71) Applicants: Brian Barnard, Sandy, UT (US); Katharine Barnard, Sandy, UT (US)

(72) Inventors: Brian Barnard, Sandy, UT (US); Katharine Barnard, Sandy, UT (US)

( * ) Notice: Subject to any disclaimer, the term of this patent is extended or adjusted under 35 U.S.C. 154(b) by 0 days.

(21) Appl. No.: 14/510,236

(22) Filed: Oct. 9, 2014

(51) Int. Cl.
*A46B 17/06* (2006.01)
*B08B 3/12* (2006.01)

(52) U.S. Cl.
CPC *A46B 17/06* (2013.01); *B08B 3/12* (2013.01)

(58) Field of Classification Search
CPC ..... B08B 3/044; B08B 3/045; B08B 3/047; B08B 3/12; A46B 17/06; A46B 17/065; B44D 3/003; A63B 57/60
See application file for complete search history.

(56) References Cited

U.S. PATENT DOCUMENTS 1,470,242 A * 10/1923 Overton ..... D06F 58/10 34/195
2,168,635 A * 8/1939 Wallace ..... E05C 17/44 292/338
2,354,898 A 12/1942 Wiksten
3,343,657 A * 9/1967 Speshyock ..... A45C 11/005 134/901
3,946,877 A 3/1976 Galicia
4,403,364 A 9/1983 Schroeder
4,442,852 A * 4/1984 Lord ..... B08B 3/12 134/135
4,467,490 A * 8/1984 Adams ..... B60S 3/045 15/105
4,759,384 A 7/1988 Kliewer
4,806,770 A 2/1989 Hylton et al.
4,823,424 A 4/1989 Allen
4,912,797 A 4/1990 Brackett
5,213,121 A 5/1993 O'Brien et al.
5,701,626 A 12/1997 Zara
5,732,435 A * 3/1998 Williams ..... A63B 57/60 15/104.92
7,086,112 B2 8/2006 Smith
7,213,603 B2 5/2007 Pinsky
7,296,319 B2 11/2007 Brackett
7,513,006 B2 4/2009 Bracket
7,594,291 B1 9/2009 Carmen
8,185,994 B2 5/2012 Brackett
2004/0129580 A1* 7/2004 Cochran ..... A47K 1/09 206/15.2
2010/0186780 A1* 7/2010 Larocca ..... A61C 19/002 134/105
2014/0096801 A1 4/2014 McCormick et al.

* cited by examiner

*Primary Examiner* — David Cormier
(74) *Attorney, Agent, or Firm* — Jones Waldo Holbrook & McDonough, PC; Brent T. Winder

(57) ABSTRACT

A device for cleaning a cosmetic brush that has bristles and a liquid sensitive section. The device includes an ultrasonic bath and a lid. The ultrasonic bath is capable of holding a cleaning liquid in a reservoir. It also has an upper surface on which the lid can be placed. The lid includes one or more slots capable of receiving the cosmetic brushes and positioning them in a substantially vertical position. The slots also serve to hold the bristles in the cleaning liquid while leaving the liquid sensitive sections of the brushes substantially dry.

14 Claims, 11 Drawing Sheets

COSMETIC BRUSH CLEANING DEVICE

BACKGROUND

Cosmetic and makeup brushes come in a variety of styles and configurations. For example, when applying or finishing makeup, one might use fan brushes, brow brushes, powder brushes, blending brushes, lip brushes, kabuki brushes, angled eye brushes, stippling brushes, eye shadow brushes, angled brushes, concealer brushes, flat brushes, smudge brushes and angled liner brushes alone or in combination. Because of the nature of their use, such brushes can, over time, begin to accumulate old makeup, dirt and debris, dead skin cells, oils and bacteria making them unsanitary and unsuitable for use.

A widely used brush cleaning protocol involves swirling the wetted brush on a soap bar or in a soapy solution followed by rinsing in warm water. Excess water is then squeezed out and the brushes are laid down on a clean towel or in a cup to dry. There are a variety of problems with conventional cleaning techniques in terms of the thoroughness of the cleaning and brush longevity.

For example, conventional cleaning techniques generally recommend that the water not be allowed to get above the brush shaft as doing so can 1) cause the metal to rust; and 2) dissolve the bristle glue, causing the bristles to fall out. Moreover, many brushes have handles that are made of wood or other materials that would be warped, deformed or simply ruined if wetted or submerged in water repeatedly or over a prolonged period of time. The handles may also have finishes that are water soluble or at least water-sensitive over time.

When using a bowl or other container of soapy water, it is cumbersome to have to hold the brushes under the water at just the right level. When holding the brushes under running water, it is similarly cumbersome to have to position the brushes with enough precision that water-sensitive brush features will not be negatively impacted. The foregoing technique is also disadvantageous in that it generally involves a more forceful manipulation of the bristles during cleaning—which, over time, will cause then to fall out prematurely. Such techniques also potentially introduce additional bacteria into the bristles from the hands of the person cleaning. Residual soaps on the bristles left by inadequate rinsing can also negatively impact the longevity of the brushes and may cause skin irritation for the user.

Conventional drying techniques—i.e. laying the brushes down on a towel to dry or propping them up in a cup or other similar container—also present a variety of potential issues relating to brush cleanliness and longevity. For example, the orientation of the brushes on the towel or other drying surface also generally means that the brushes are sitting in a wet environment for a longer period of time making them more likely to rust and warp. A prolonged wet environment is also conducive to bacteria growth. Such drying techniques can also deform the bristles as laying flat they are, at least in part, often bearing the weight of the brushes during the drying process. Additionally, towel drying techniques take a long time—e.g. some sources recommend six to eight hours of drying time—making brush cleaning a slow and inconvenient process that understandably becomes much less desirable. Propping the brushes in a cup or similar container also has several disadvantages. If the bristles are oriented upward, the water runs down into the glue causing it to dissolve over time. If the bristles are oriented downward, they are smashed flat during the drying process which can cause them to bend or fall out more quickly, thus significantly decreasing their longevity.

It has been discovered by applicant that ultrasonic baths are particularly effective at cleaning makeup brushes. In particular, ultrasonic baths have previously been used to clean certain types of jewelry as well as lenses and other optical parts, watches, dental and surgical instruments, tools, coins, fountain pens, golf clubs, window blinds, firearms, musical instruments, industrial parts and electronic equipment. However, they have been found to be especially well-suited for removing old makeup, dirt and debris, dead skin cells, oils and bacteria from the bristles of makeup brushes.

Even though the ultrasonic cleaning technique lends itself very well to use on makeup brushes, conventional ultrasonic cleaners—such as jewelry cleaners—cannot at present be used for such a purpose. To do so would require one to lay the brushes down submerged in the bathing solution—which, as noted above, would tend to quickly ruin the brushes and, would at a minimum scratch, dent and scuff the handles. Alternatively, propping the brushes vertically along the edge of the bath is not an adequate solution as 1) the vibration from the bath tends to tip them over; and 2) such an orientation leaves the brush bristles smashed against the bottom of the bath—which impairs their cleaning and causes them to more quickly degrade.

The present invention in its various embodiments solves all of the foregoing limitations. It is a makeup brush cleaner that employs the benefits of ultrasonic cleaning methods; but also avoids the unwanted wear on the brushes caused by such cleaning techniques. It also addresses many of the shortcomings of conventional brush cleaning techniques.

The present invention in its various embodiments can utilize off-the-shelf ultrasonic jewelry cleaning baths; or it can be utilized with more customized ultrasonic baths. It includes a retaining lid having one or more slots that hold the makeup brushes in place in the proper orientation and at the optimum depth as they are cleaned in the ultrasonic bath. It allows for easy insertion and removal of the brushes. It allows for relatively quick drying and does so without rusting the brush shaft or dissolving the bristle glue. The present invention in its various embodiments can accommodate a wide variety of brush sizes and styles and allows for their cleaning without ruining, damaging or deforming the handle or handle materials. The foregoing advantages as well as others are provided for by the invention in its various embodiments.

SUMMARY OF THE CLAIMED INVENTION

The presently claimed invention is a device for cleaning a cosmetic brush that has bristles and a liquid sensitive section—such as handles or glues that would be damaged or destroyed by repeated or excessive exposure to liquids. The device includes an ultrasonic bath and a lid. The ultrasonic bath is capable of holding a cleaning liquid in a reservoir. It also has an upper surface on which the lid can be placed. The lid includes one or more slots capable of receiving the cosmetic brushes and positioning them in a substantially vertical position. The slots also serve to hold the bristles in the cleaning liquid while leaving the liquid sensitive sections of the brushes substantially dry. In one embodiment, the slots are tapered. In other embodiments, the slots include a gripping mechanism. The preferred gripping mechanism is silicone; but it can be other materials. In one embodiment, the gripping mechanism is an insert. Again, this insert is preferably made of silicone; but other materials could be utilized. The inserts can include steps that allow for an easier and more secure fit in the lid. In certain embodiments, the inserts are held in place by a brace. The brace can be on the underside of the lid. The lid can be hingedly connected to the ultrasonic bath. It can also include one or more kickstands that allow the lid to be suspended—thus raising the brush bristles out of the cleaning liquid for drying. The kickstand can be pivotally attached to the lid. In certain embodiments, this pivotal attachment is accomplished through a bracket on the lid. In yet other embodiments, the hinge is a suspension hinge and no kickstand is required. The cleaning liquid could be water or cleaning solutions. The ultrasonic bath can be off the shelf or a custom designed bath. When customized, the upper surface of the bath can be designed to correspond to features on the lid to create a friction fitting that helps keep the lid secured in a closed position.

DETAILED DESCRIPTION OF THE DRAWINGS

Figure 1:
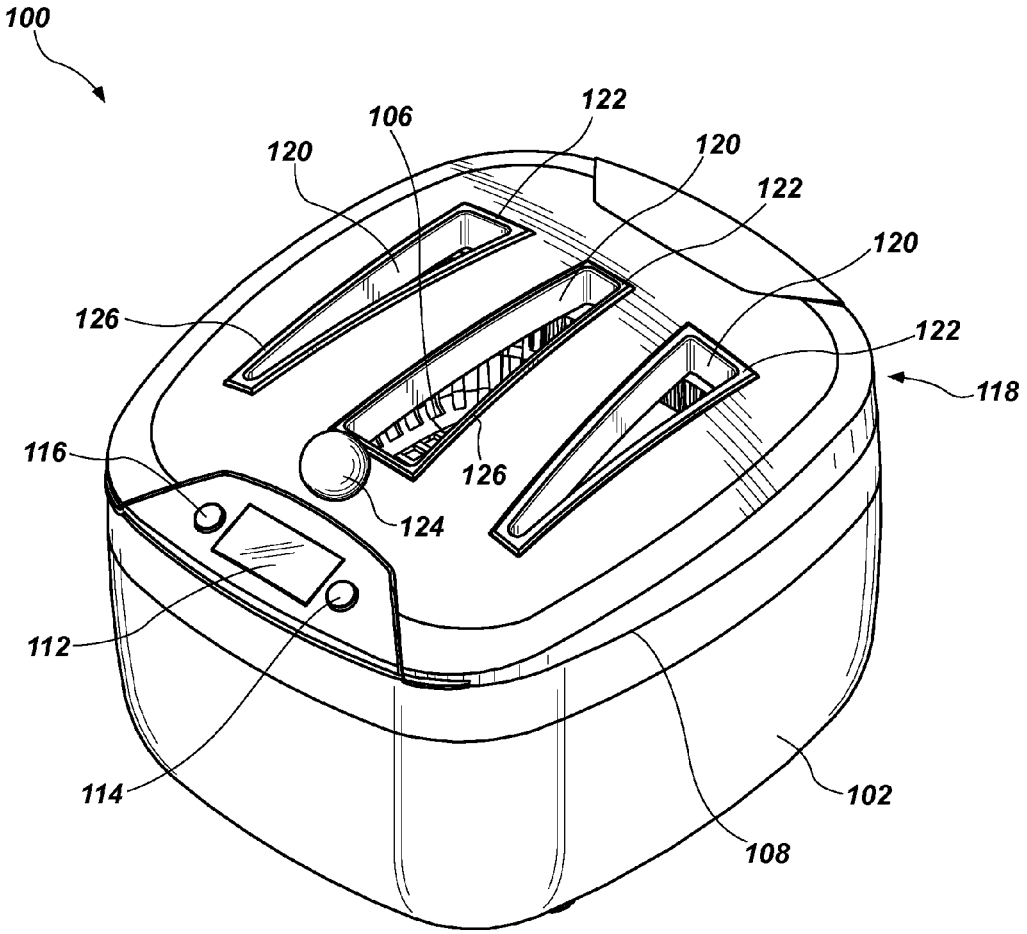
FIG. 1 shows a front perspective view of a cosmetic brush cleaning device according to one embodiment of the present invention.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Referring to FIGS. 1-4, a cosmetic brush cleaning device 100 is shown according to one embodiment of the present invention. The cleaning device 100 includes an ultrasonic bath or cleaning machine 102. The ultrasonic bath 102 includes a reservoir 104 into which water or a cleaning solution is placed. The reservoir 104 will typically be made of stainless steel or other similar non-corrosive materials that will allow the transmission of ultrasonic waves. However, it could also be made of other materials as would be apparent to one skilled in the art. It is noted that the present invention is suitable for either a customized ultrasonic bath or an off the shelf bath. In particular, current ultrasonic jewelry cleaners are well-suited for use with the present invention.

In some instances, the ultrasonic bath 102 will be equipped with a basket 106. This allows the ultrasonic bath 102 to provide multi-functionality—e.g. it can serve the present purpose of cleaning cosmetic brushes; but can also, when desired, serve as a conventional cleaner for jewelry or other items as may be in need of ultrasonic cleaning.

Figure 2:
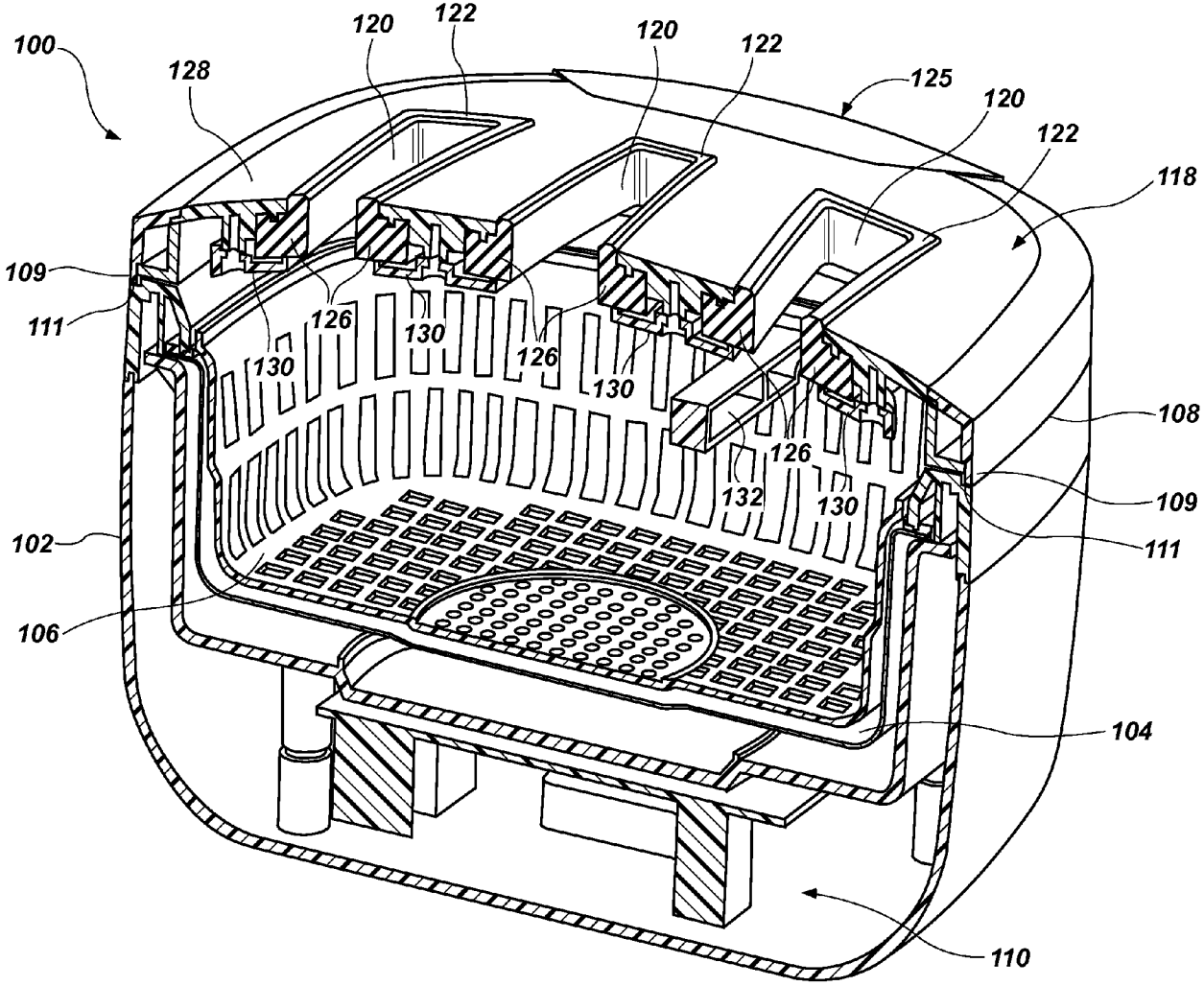
FIG. 2 shows a front sectional view of the cosmetic brush cleaning device of FIG. 1.

For custom models, the upper rim 108 of the bath 102 can include specific design features that allow for a closer and more secure fit with the lid portion 118. In the presently depicted embodiments and as best seen in FIG. 2, the upper rim 108 can include a notch 111 that corresponds to a ridge 109 in the lid portion. This ridge/notch coupling can create a slight friction fitting that helps keep the lid secured in a closed position. In other embodiments, the top rim 108 could be substantially flat and a corresponding flat surface could be included on the underside of the lid portion 118. In yet other embodiments, and particularly in situations where an off the shelf ultrasonic bath is being used, the underside surface of the lid portion 118 could include more pliable materials such as silicone or foams that would allow it to conform to and accommodate a wide variety of upper rim 108 shapes.

Figure 3:
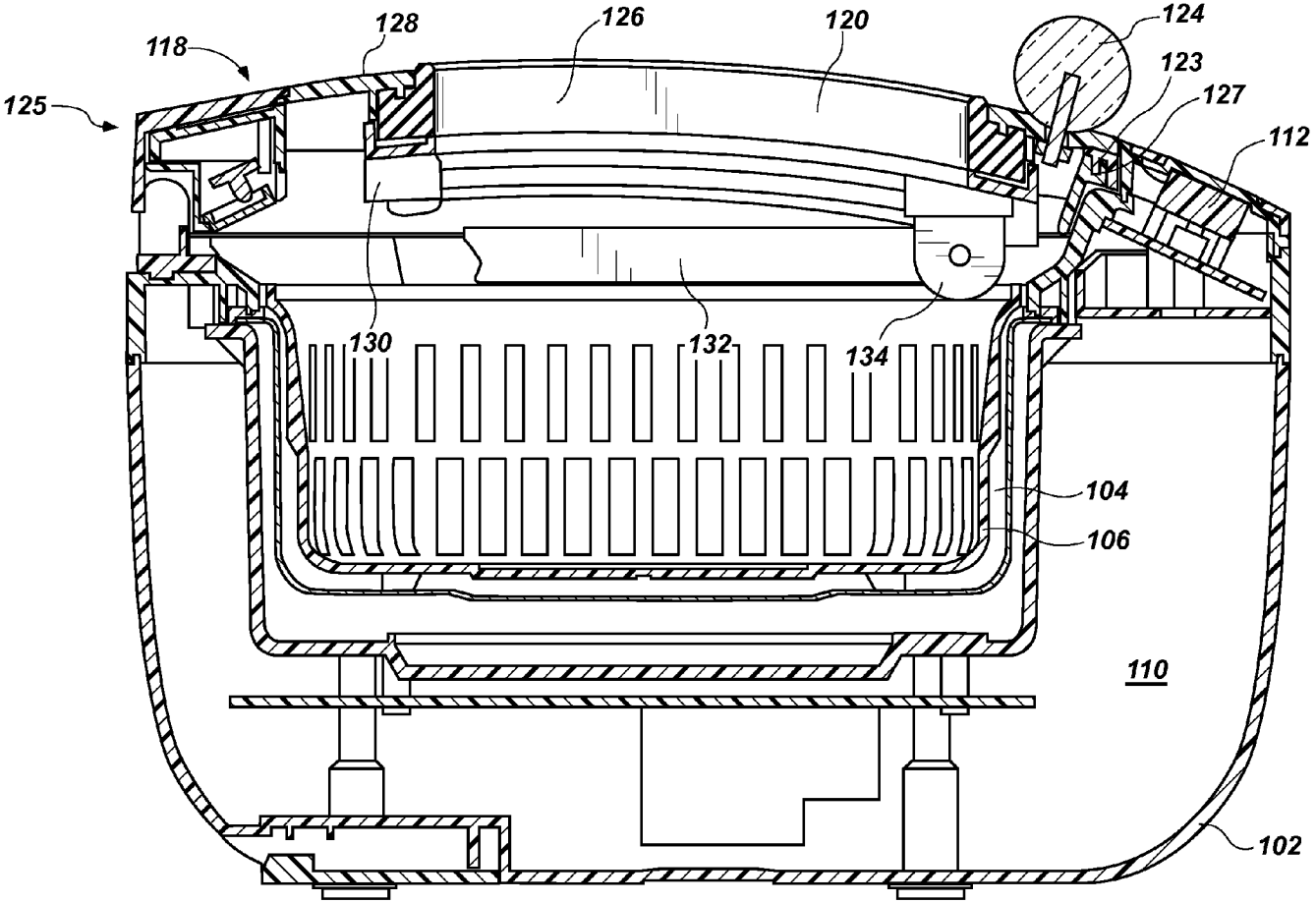
FIG. 3 shows a side sectional view of the cosmetic brush cleaning device of FIG. 1.
Figure 4:
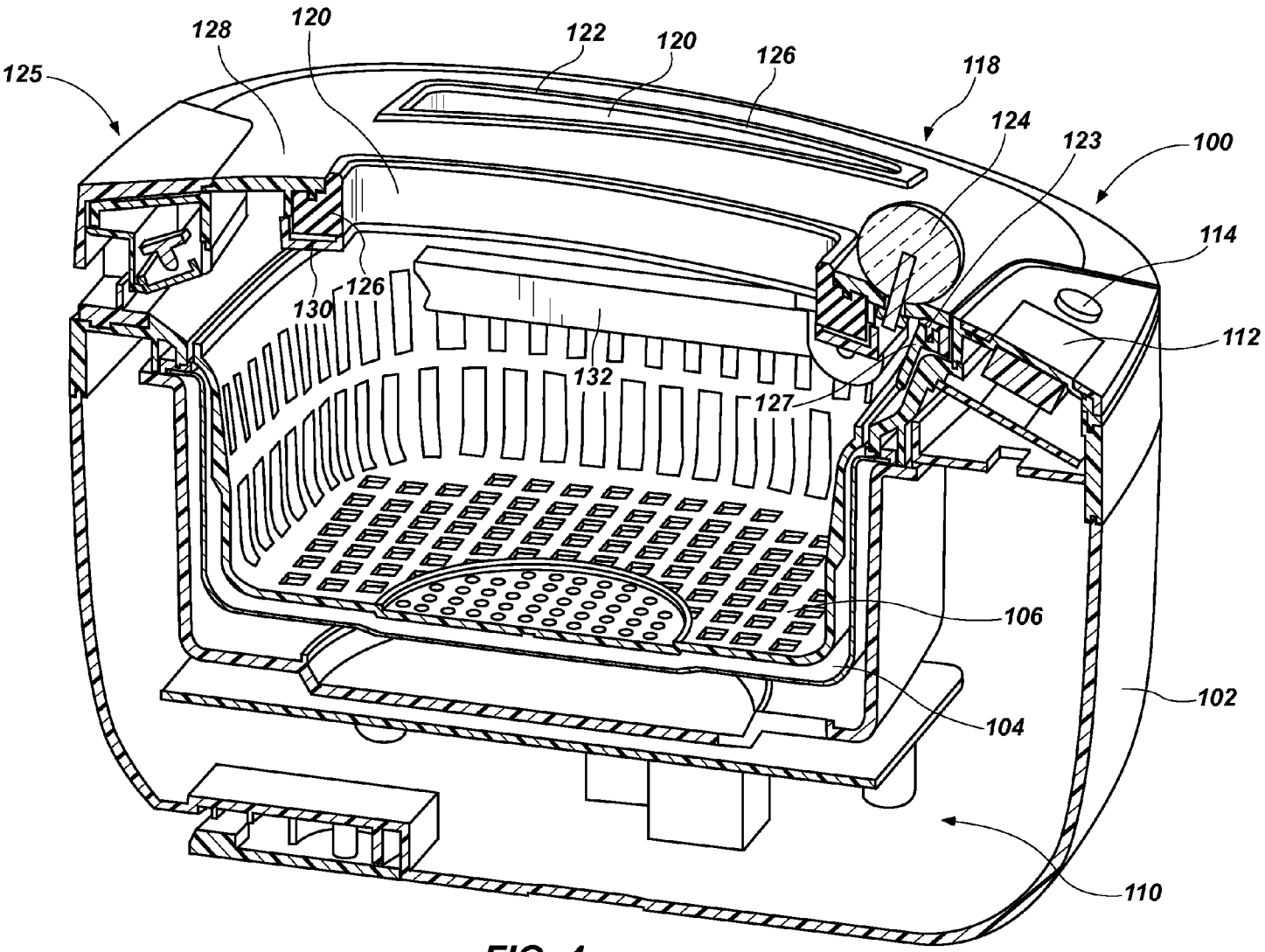
FIG. 4 shows a side sectional perspective view of the cosmetic brush cleaning device of FIG. 1.

As seen in FIG. 3, additional securing fittings can also be included to keep the lid 118 in a closed position. For example, in this embodiment, the lid portion 118 includes a male locking member 123 that corresponds to a female fitting 127 on the upper rim 108 of the bath 102. Numerous other connection mechanisms would be apparent to one skilled in the art and are considered within the scope of the present invention.

Standard ultrasonic components as are known in the art are typically in the space 110 surrounding and defining the reservoir 104. The bath 102 will typically include a display 112 indicating ultrasonic settings, time and other data and one or more buttons 114, 116 for powering the device, controlling timers, etc. Numerous other display and powering features may be utilized as would be apparent to one skilled in the art. For example, in some instances, switches or dials could be used. In some embodiments, no display is included. All such embodiments are considered within the scope of the present invention.

Figure 5:
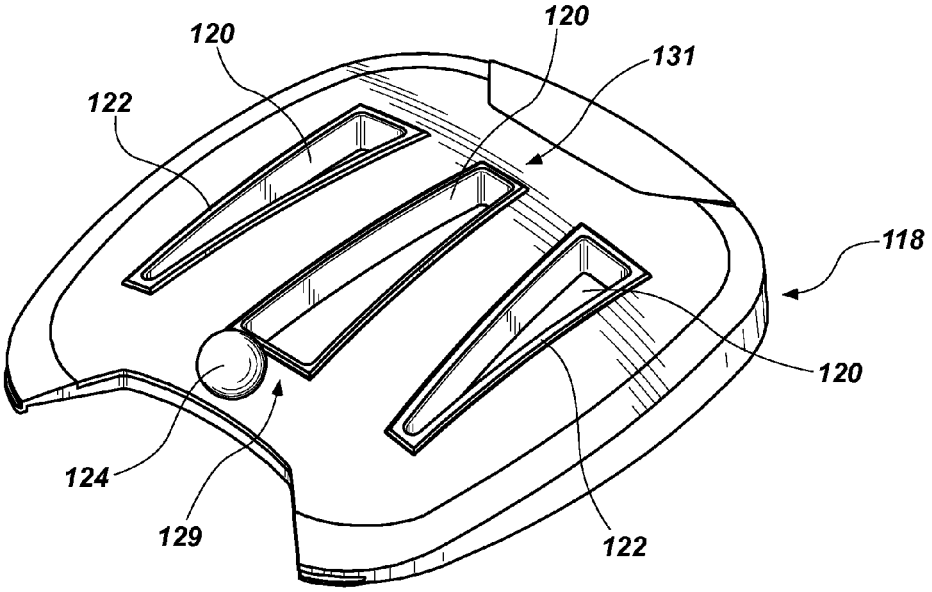
FIG. 5 shows a front sectional view of a lid portion of the present device according to one embodiment of the present invention.
Figure 6:
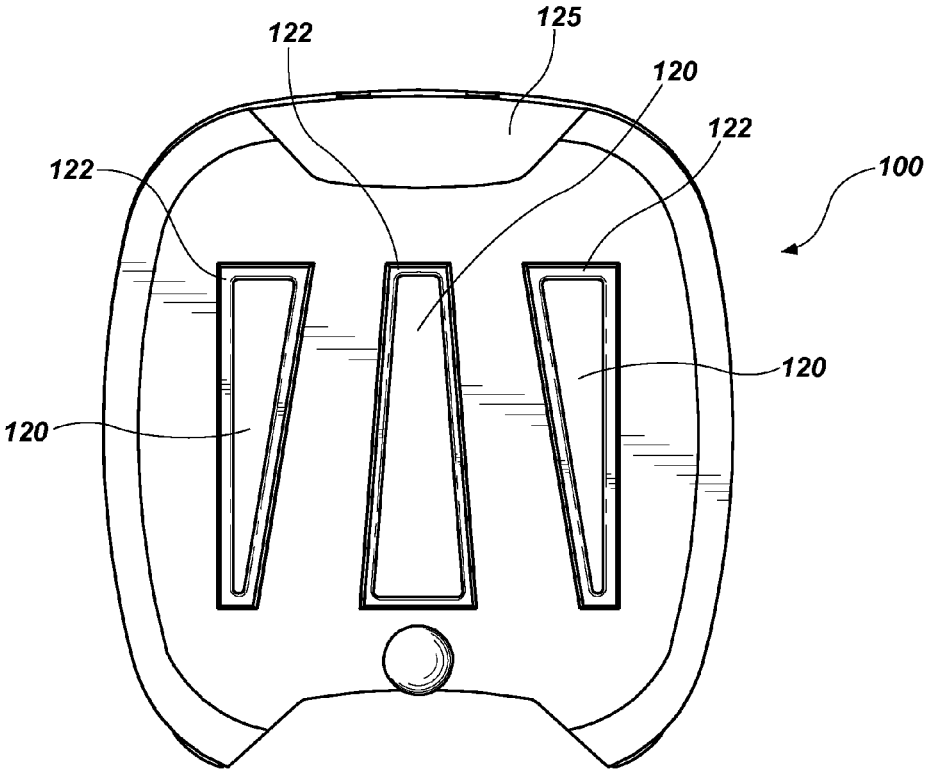
FIG. 6 shows a top view of the lid portion section of FIG. 5.
Figure 7:
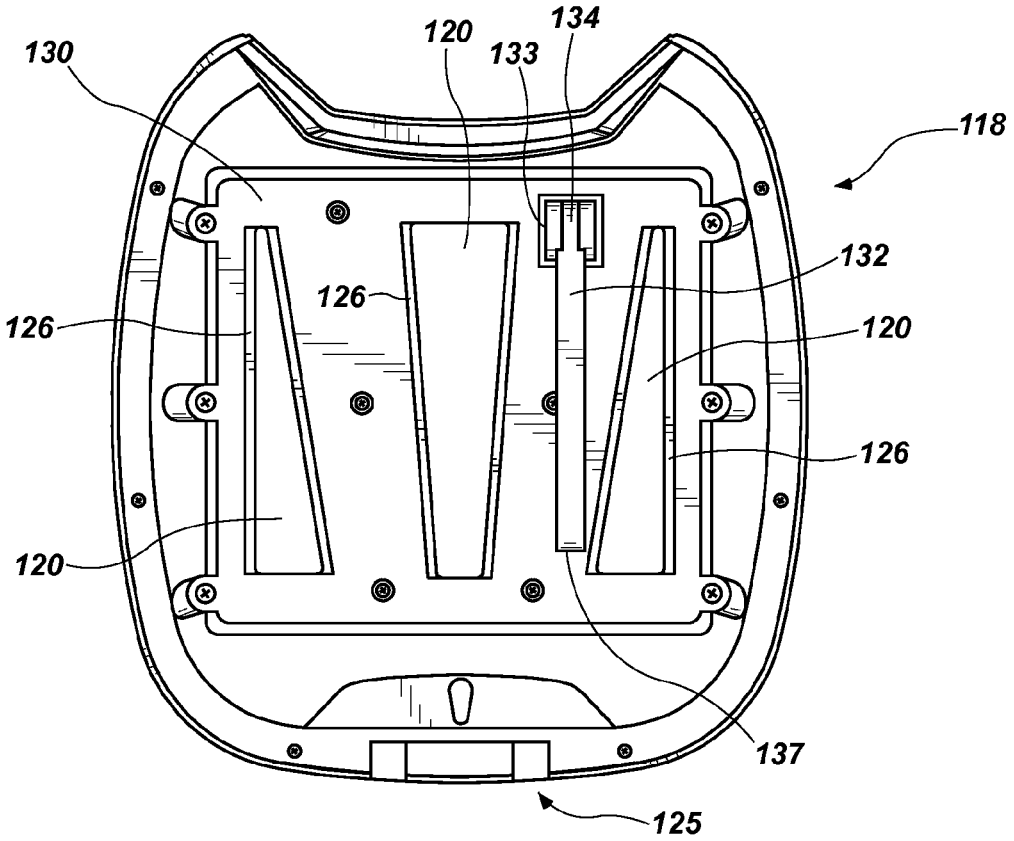
FIG. 7 shows a bottom view of a lid portion of the present device according to one embodiment of the present invention.
Figure 8:
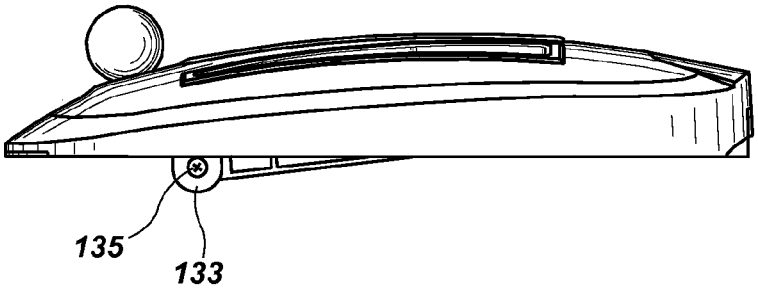
FIG. 8 shows a side view of the lid portion section of FIG. 7.
Figure 9:
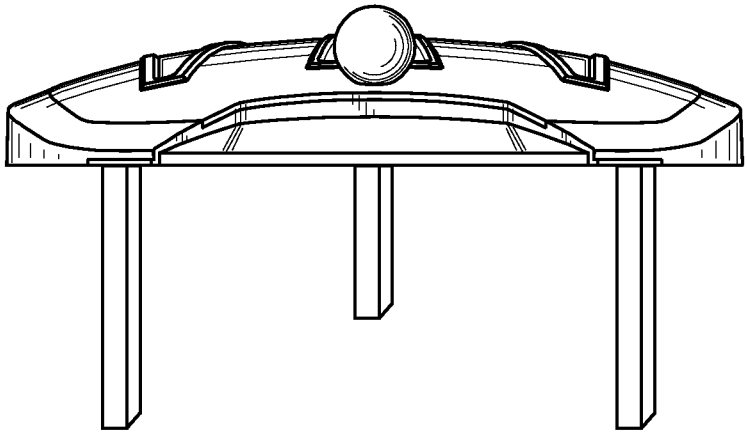
FIG. 9 shows a front view of a lid portion section according to one embodiment of the present invention.
Figure 10:
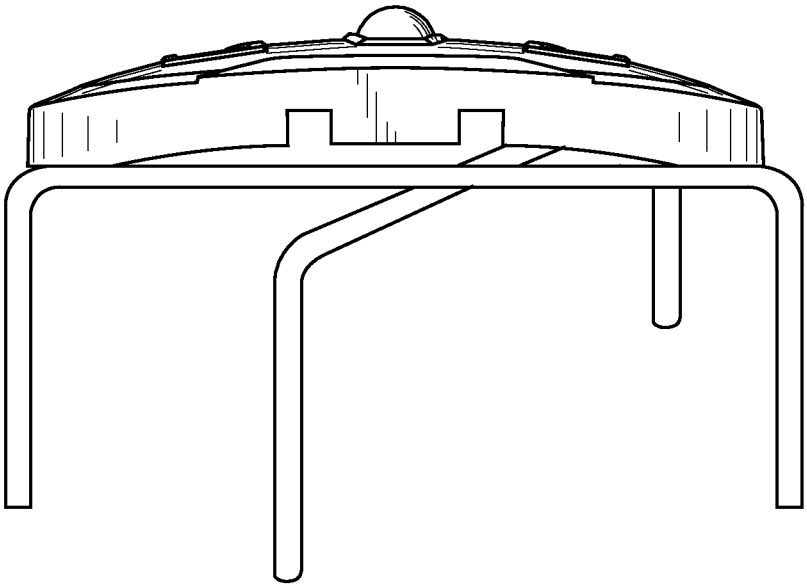
FIG. 10 shows a rear view of a lid portion section according to one embodiment of the present invention.
Figure 16:
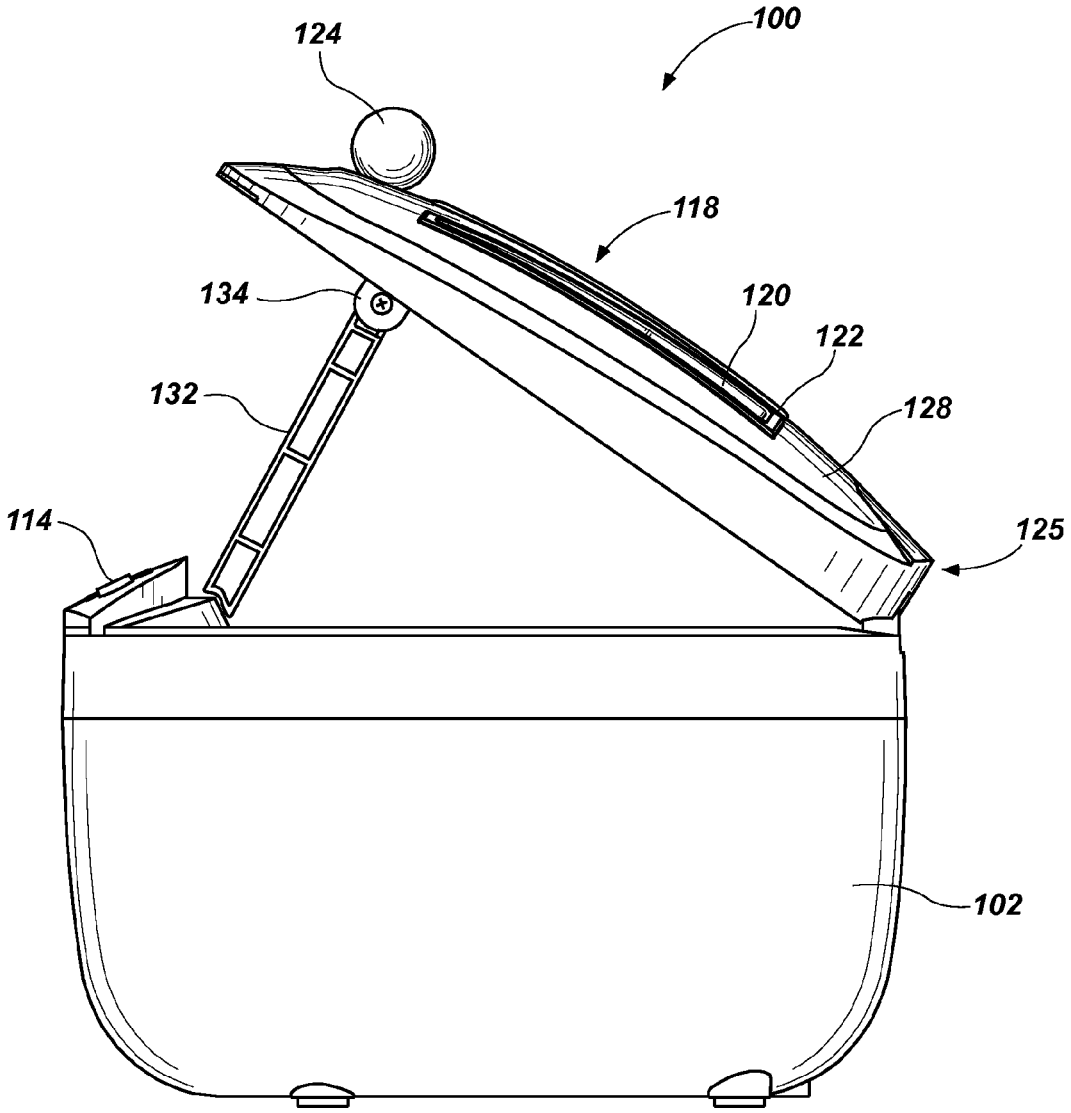
FIG. 16 shows a cosmetic brush cleaning device according to one embodiment of the present invention with the kickstand feature engaged.

Referring now to FIGS. 5-6, the lid portion 118 includes one or more tapered slots 120 that are configured to receive one or more cosmetic brushes. In operation, a user could insert the brush into the larger end 129 of the slot 120 from above or beneath the lid and then slide it toward the narrower end 131 until a snug fit is achieved. In this manner, the cosmetic brush would end up in a substantially vertical position with the handle end and brush shaft, safely above the fluid line and the bristles suspended in the water or cleaning solution. The desired ultrasonic cycle can then be initiated. Once complete, lid 118 can be removed and suspended on one or more legs (FIG. 9) or a drying rack (FIG. 10). Alternatively, as shown in FIGS. 7 and 16, a kickstand 132 can be engaged raising the bristle ends up out of the cleaning solution for drying. As best depicted in FIGS. 3 and 8, the kickstand 132 can be pivotally attached to the underside of lid 118. In this example, one end of the kickstand 132 is rotatably secured at one end 134 to a bracket 133 with a screw 135 or other similar fastening mechanism. Thus, when drying the brushes, one would swing the kickstand out approximately ninety (90) degrees and set the distal end 137 of the kickstand on a receiving platform on the bath 102. The receiving platform could be specifically designed or any suitably located protrusion or surface on the bath 102 could function as the platform.

The lid 118 can be hingedly attached to the bath 102. A hinging mechanism 125 is depicted in FIG. 7. Numerous hinging mechanisms as would be apparent to one skilled in the art could be employed for use with the present invention. The hinging mechanism 125 allows the user to, in combination with the kickstand 132, raise the brush bristles out of the ultrasonic cleaning solution to dry. However, in other embodiments, it may be desirable to not include a hinged connection. For example, in some embodiments the lid simply rests on top of the ultrasonic bath 102 while the brushes are being cleaned. It can include friction of other similar connection mechanisms to help ensure a snug fit. When the brushes are clean, the lid could simply be removed and placed, along with the brushes therein, aside to dry. Such a lid 118 would be useful in connection with legs and drying racks as depicted in and discussed in connection with FIGS. 9 and 10. In yet other embodiments, a suspended hinging mechanism could be used. In such an embodiment, no kickstand feature 132 would be required.

The kickstand 132 can include a locking mechanism that helps urge it in an extended position until manually retracted by a user. It is noted that other connection mechanisms could be utilized for the kickstand 132. For example, in one embodiment, the kickstand 132 is not really a kickstand at all in that it is not pivotally connected to the lid 118. Rather, it is a removable support beam that can be secured to the lid through a variety of connection mechanisms as would apparent to one skilled in the art. When suspension of the lid 118 is desired, the support beam would be removed and then one end would be inserted into a receptacle on the lid 118 and the other end into a receptacle on the bath 102.

In yet other embodiments, the pivotal connection of the kickstand 132 could be accomplished with a hinge or other similarly rotatable connection mechanism as would be apparent to one skilled in the art. All of the foregoing are considered within the scope of the present invention as claimed.

It is noted that, in certain embodiments, the kickstand feature 132 may be longer or shorter depending on the desired drying angle. With a shorter kickstand 132, the drying angle would be closer to zero (0) degrees; whereas with a longer kickstand 132, the drying angle would be closer to ninety (90) degrees. Angled drying (i.e. a drying angle of less than ninety (90) and greater than zero (0) degrees) of the inverted brush is beneficial in that it discourages water from flowing back toward the brush shaft and handle—which over time dissolves the glue holding the bristles in place.

Figure 11:
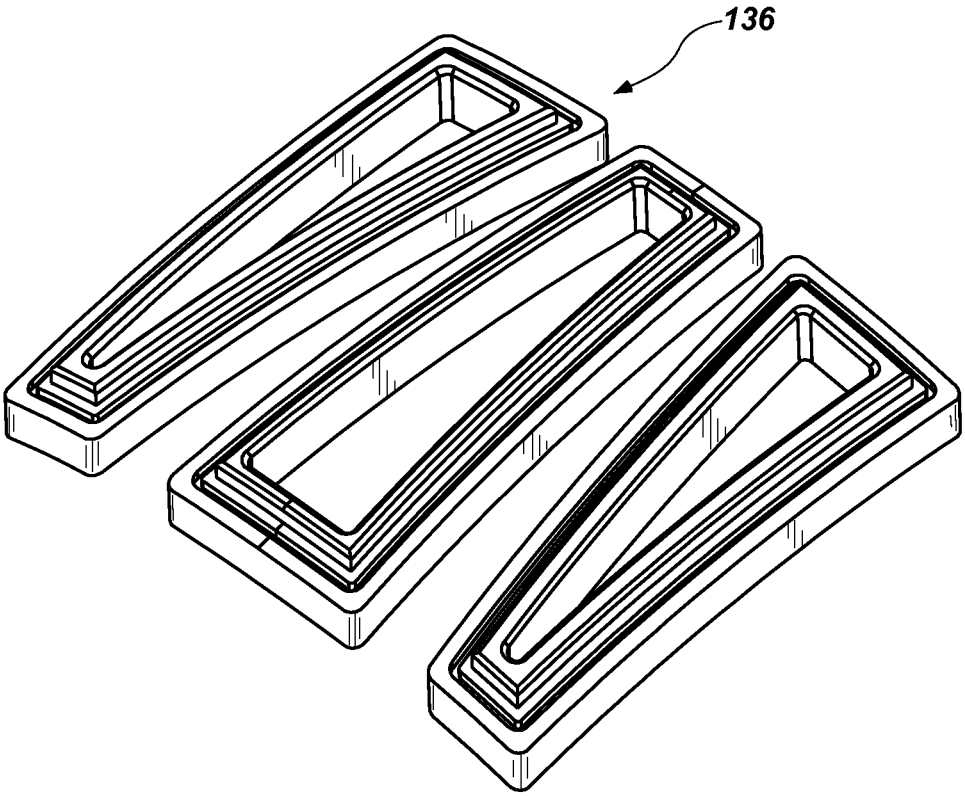
FIG. 11 shows a perspective view of the inserts according to one embodiment of the present invention.

Referring to FIGS. 7 and 11, in one embodiment, the tapered slots 120 are lined with a gripping material 122. It has been discovered that silicone, and more particularly a silicone insert 126 as depicted in FIG. 11 is particularly well suited as a gripping material 122. The inserts 126 hold the brush handles firmly without damaging them. They are easy to install and remove. They allow the slots 120 to accommodate a wide variety of brush sizes and shapes. They can also be easily cleaned and disinfected; will not deform over time; and are tear resistant.

While the silicone inserts 126 are preferred, they could in other embodiments be made of other materials including but not limited to neoprene and other foams; plastics; textiles; and rubber alone or in combination. It is also noted that in certain embodiments, it may be desirable to apply a liquid gripping material 122 to the slots 120 rather than affixing an insert 126.

As seen in FIG. 11, the inserts 126 can include a series of steps 136 that correspond to the slots 120 and create a friction fitting on underside of the lid. As shown in FIG. 7, the inserts 126 can be further secured to the lid with a brace 130. In the presently illustrated embodiments, the brace 130 is made of plastic; but could be made of other materials as would be apparent to one skilled in the art. It is noted that in some embodiments, the brace 130 may not be required. In yet other embodiments, the inserts 126 could be secured to the lid 118 by adhesives, or other mechanical fittings such as a tongue and groove fitting.

It is noted that the presently illustrated embodiments depict the slots 120 as being oriented substantially parallel along an axis between the front and back of the device 100. However, in other embodiments, it may be advantageous to have the slots 120 oriented perpendicularly along such an axis. In yet other embodiments, there may be configurations of slots 120 in varied patterns or in no particular pattern.

It is also noted that the kickstand feature 132 is shown running substantially parallel to an axis between the front and back of the device 100 with a front to back orientation. In other embodiments, it may be advantageous to have the kickstand 132 oriented perpendicularly along such an axis. In yet other embodiments, there may be more than one kickstand 132.

Figure 12:
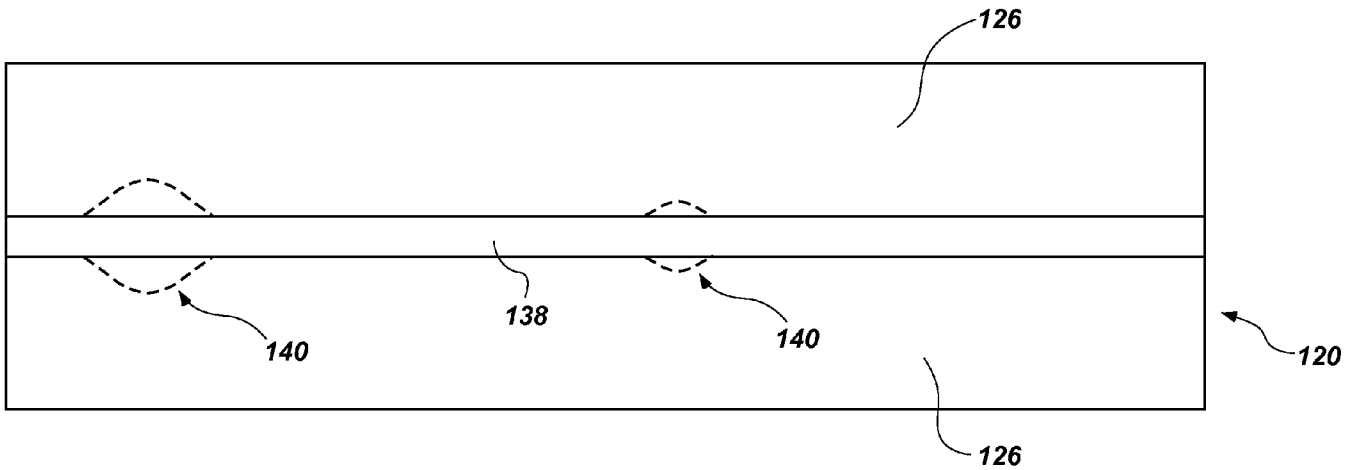
FIG. 12 shows a top view of a slot configuration according to one embodiment of the present invention.
Figure 13:
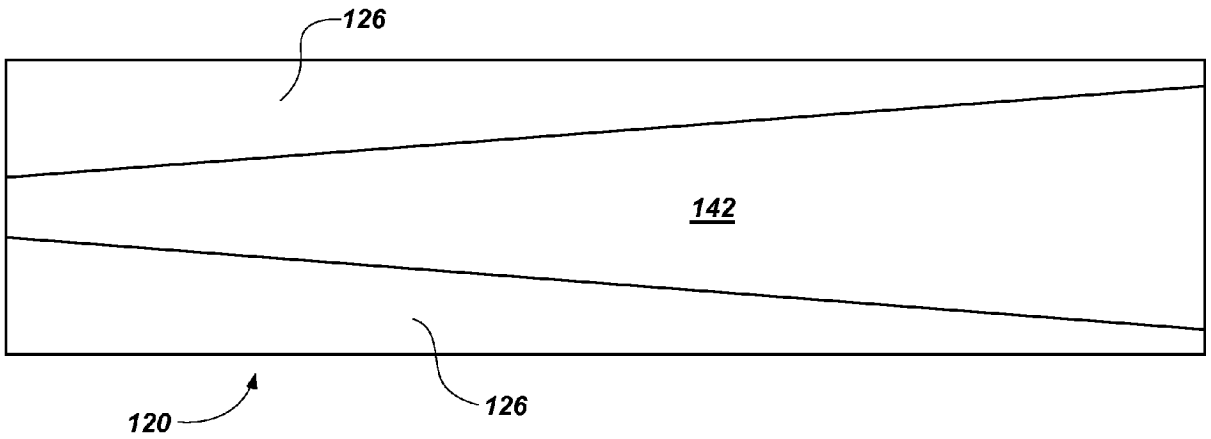
FIG. 13 shows a top view of a slot configuration according to one embodiment of the present invention.

Referring now to FIGS. 12-15, other slot 120 configurations may be utilized in connection with the present invention. In FIG. 12, the slot 120 is substantially rectangular. The gripping material 122, which in this embodiment is insert 126, largely fills the slot leaving only a narrow channel 138 into which the brushes can be inserted. In such a configuration, the insert 126 would need to be a soft, malleable and resilient material that would allow it to be temporarily displaced by the brushes; but then reform around them to secure them in place. Soft silicone has been found to be well suited for such an insert. While silicone is preferred, the insert 126 could in other embodiments be made of other materials including but not limited to neoprene and other foams; plastics; textiles; and rubber alone or in combination. In FIG. 12, broken lines 140 depict brush displacement.

In FIG. 13, the slot 120 is again rectangular; but the gripping material 122—which in this illustration is insert 126 (though it could be other types of gripping materials 122)—creates a tapered channel 142. Again, this channel configuration would accommodate a wide variety of brush sizes and styles.

Figure 14:
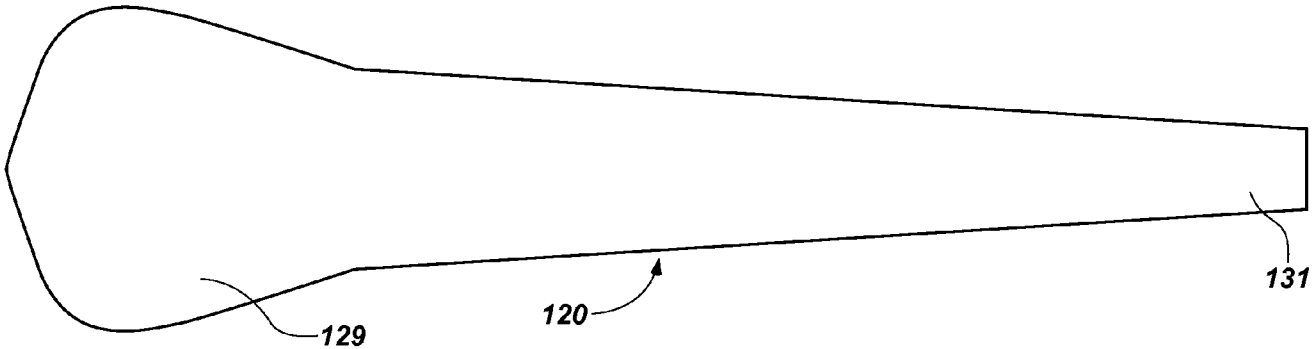
FIG. 14 shows a top view of a slot configuration according to one embodiment of the present invention.
Figure 15:
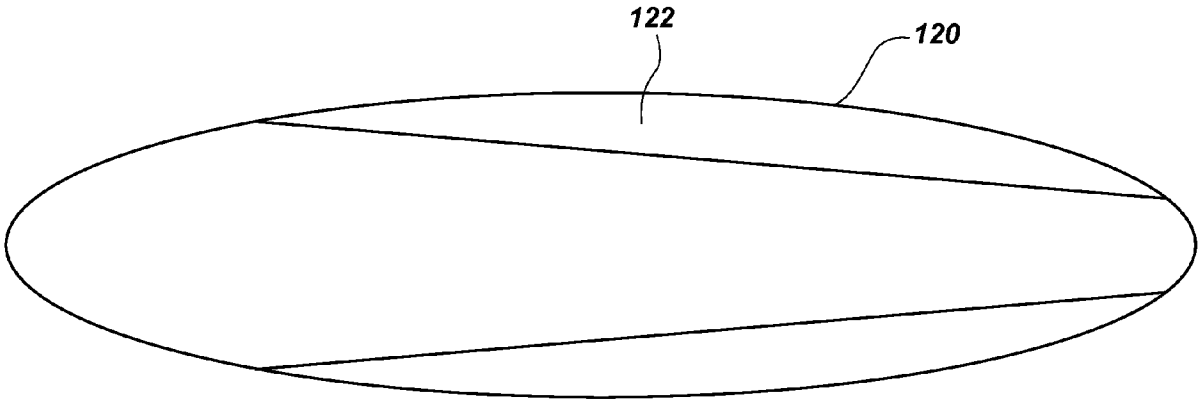
FIG. 15 shows a top view of a slot configuration according to one embodiment of the present invention.

FIG. 14 illustrates another possible slot 120 configuration. This configuration still includes tapering; but has a more rounded larger end 129. Gripping materials 122 such as inserts 126 could again be employed in such an embodiment. FIG. 15 illustrates an embodiment where the slot 120 is oval and the insert 126 (or other form of gripping material 122) forms a substantially tapered opening into which the brushes can be inserted.

FIG. 16 is a depiction of a brush cleaning device 100 with the lid 118 opened and the kickstand 132 engaged.

Lid 118 can also include one or more handles 124—which in the presently illustrated embodiment is a decorative pearl handle. Numerous other handles would be apparent to one skilled in the art. In some embodiments there would be no handle 124 and the lid 118 could be lifted or removed by notches or other known grasping mechanisms. It is also noted that the lid 118 could be made of numerous materials as would be apparent to one skilled in the art. Moreover, while the lid is generally depicted as different component parts, it could also be a single molded piece.

It is understood that the above-described arrangements are only illustrative of the application of the basic principles of the present invention. Numerous modifications and alternative arrangements may be devised by those skilled in the art without departing from the spirit and scope of the present invention. The appended claims are intended to cover such modifications and arrangements.

The invention claimed is:

1. A device for cleaning a cosmetic brush having a bristle section and a liquid sensitive section, the device comprising:

a) an ultrasonic bath having an upper surface and a bath reservoir capable of holding a cleaning liquid;

b) a lid capable of being placed on the upper surface of the ultrasonic bath, wherein the lid includes one or more slots having a first tapering side and a second tapering side to create a first end that is narrower than a second end and wherein the one or more slots include a malleable gripping mechanism lining that substantially conforms to a brush handle whereby the one or more slots are capable of receiving the cosmetic brush and positioning it in a substantially vertical position and wherein the bristle section is in the cleaning liquid and the liquid sensitive section is above the cleaning liquid.

2. The device of claim 1 wherein the lid is hingedly connected to the ultrasonic bath.

3. The device of claim 2, further comprising a kickstand having a first and second end.

4. The device of claim 3, wherein the first end of the kickstand is pivotally attached to the lid.

5. The device of claim 4, wherein the kickstand is pivotally attached to the lid with a bracket.

6. The device of claim 2, wherein the lid is hingedly connected to the ultrasonic bath with a suspension hinge.

7. The device of claim 1 wherein the cleaning liquid is water.

8. The device of claim 1 wherein the ultrasonic bath includes a notch in the upper surface.

9. The device of claim 8 wherein the lid includes a ridge that corresponds to the notch in the upper surface thereby creating a friction fitting that helps keep the lid secured in a closed position.

10. The device of claim 1, wherein the gripping mechanism lining is substantially made of silicone.

11. The device of claim 1 wherein the gripping mechanism lining is an insert.

12. The device of claim 11 wherein the insert is substantially made of silicone.

13. The device of claim 11 wherein the insert includes one or more steps.

14. The device of claim 11 wherein the insert is held in place by a brace.

* * * * *